US012220021B2

(12) United States Patent
Parisotto et al.

(10) Patent No.: US 12,220,021 B2
(45) Date of Patent: Feb. 11, 2025

(54) THERMAL-INSULATING INNER-BOOT FOR MOUNTAIN BOOTS AND HIGH THERMAL-INSULATION MOUNTAIN BOOT

(71) Applicant: CALZATURIFICIO S.C.A.R.P.A. S.P.A., Asolo (IT)

(72) Inventors: Davide Parisotto, Asolo (IT); Marco Bettin, Asolo (IT)

(73) Assignee: CALZATURIFICIO S.C.A.R.P.A. S.P.A. (IT)

( * ) Notice: Subject to any disclaimer, the term of this patent is extended or adjusted under 35 U.S.C. 154(b) by 20 days.

(21) Appl. No.: 17/965,115

(22) Filed: Oct. 13, 2022

(65) Prior Publication Data

US 2023/0122436 A1 Apr. 20, 2023

(30) Foreign Application Priority Data

Oct. 20, 2021 (IT) ..... 102021000026984

(51) Int. Cl.

| | |
|---|---|
| ***A43B 7/34*** | (2006.01) |
| ***A43B 5/00*** | (2022.01) |
| ***A43B 19/00*** | (2006.01) |
| ***A43B 23/06*** | (2006.01) |
| ***A43B 23/07*** | (2006.01) |

(52) U.S. Cl.

CPC ..... *A43B 7/34* (2013.01); *A43B 5/002* (2013.01); *A43B 19/00* (2013.01); *A43B 23/06* (2013.01); *A43B 23/07* (2013.01)

(58) Field of Classification Search

CPC ..... A43B 7/34; A43B 5/0404; A43B 5/002; A43B 1/0018

USPC ..... 36/55, 102

See application file for complete search history.

(56) References Cited

U.S. PATENT DOCUMENTS

| | | | | |
|---|---|---|---|---|
| 2006/0130367 | A1* | 6/2006 | Liu | A43B 23/07 36/55 |
| 2008/0131648 | A1* | 6/2008 | Baychar | B32B 3/26 428/90 |
| 2015/0096201 | A1* | 4/2015 | Marcon | A43B 23/06 36/109 |

FOREIGN PATENT DOCUMENTS

IT 201800020875 A1 6/2020

* cited by examiner

*Primary Examiner* — Timothy K Trieu

(74) *Attorney, Agent, or Firm* — The Belles Group, P.C.

(57) ABSTRACT

A thermal-insulating inner-boot for mountain boots comprising: an upper with a thermal-insulating structure, which is shaped so as to cover the user's foot and lower part of the leg; and a plate-like insole with a thermal-insulating structure, which is arranged to close the lower opening of the upper so as to cover the sole of the user's foot; the upper being shaped substantially like an overturned funnel, and including a single-piece knitted fabric structure which has, inside itself, at least one cavity-wall and also at least one sheet/piece of soft and flexible thermal-insulating material that is stably trapped within said cavity-wall.

15 Claims, 3 Drawing Sheets

THERMAL-INSULATING INNER-BOOT FOR MOUNTAIN BOOTS AND HIGH THERMAL-INSULATION MOUNTAIN BOOT

CROSS-REFERENCE TO RELATED APPLICATIONS

This patent application claims priority from Italian patent application no. 102021000026984 filed on Oct. 20, 2021, the entire disclosure of which is incorporated herein by reference.

TECHNICAL FIELD

The present invention relates to a thermal-insulating inner-boot for mountain boots and a high thermal-insulation mountain boot.

More specifically, the present invention relates to a removable thermal-insulating inner-boot for mountain boots and a mountaineering boot preferably suitable for crampons. Use to which the following description will make explicit reference without thereby losing generality.

BACKGROUND

As is well known, mountaineering boots are sports footwears with high thermal insulation, which are structured to allow the user to walk, in relative safety, on glaciers and snow-covered surfaces at altitudes generally higher than 4000-5000 metres, i.e. in particularly severe and adverse climatic and environmental conditions.

The mountaineering boots currently on the market basically consist of a leather and/or synthetic waterproof upper, which is shaped so as to accommodate and protect the user's foot and leg usually up to the base of the calf, is internally lined with a lining made of thermal-insulating material, and is suitably stiffened by a front toe cap and a rear counter, both usually made of rigid plastic material; of a rigid sole with a cleated-profile, which is stably fixed underneath the upper by sewing and/or gluing so as to cover the entire sole of the user's foot, and is provided with a tread in elastomeric material with a high friction coefficient; and a lace or other manually-operated closing system, which is capable of tightening the upper on the user's foot.

Furthermore, the best mountaineering boots currently on the market are also provided with a perimeter protective band made of high-strength elastomeric material, traditionally called 'fodrone' in Italian, which surrounds and covers the lower part of the upper while joining to the underlying sole, so as to protect the upper from impact and/or abrasion.

In addition, the mountaineering boots described above also include an internal thermal-insulating inner-boot, separate and distinct from the upper, which is shaped substantially like a boot so as to accommodate and protect the user's foot and lower leg, and is inserted in easily removable manner within the upper so as to further increase the thermal insulation capability of the footwear.

In the most sophisticated mountaineering boots currently on the market, the internal thermal-insulating inner-boot basically consists of a series of pieces of fabric coupled with polymeric material foam or other thermal-insulating material, double-lined and with a thickness of 3-6 mm, which are joined together along the perimeter edge/hem by sewing and/or gluing; and a thick inner lining in fleece or other soft and thermal-insulating material.

Unfortunately, while offering very high protection from the cold, the thermal-insulating inner-boots described above are particularly laborious to produce, with the high production costs that this entails.

In addition, the thermal-insulating inner-boots described above have a poorly flexible and non-breathable structure, so the drying of the inside of the inner-boot usually takes a long time, with the operating limitations that this entails.

In fact, in the high mountains, it is extremely dangerous to use mountaineering boots that are not perfectly dry on the inside, because the temperature can reach such low values that even traces of moisture/condensation inside the thermal-insulating inner-boot are rapidly frozen, thereby exposing the user's foot to the risk of chilblains and other diseases.

SUMMARY

Aim of the present invention is to provide a thermal-insulating inner-boot for mountaineering boots, which is simpler and cheaper to produce and, with the same thermal insulation, is also lighter, more flexible and more breathable than those currently on the market.

In accordance with these aims, according to the present invention there is provided a thermal-insulating inner-boot for mountain boots as defined in claim 1 and preferably, though not necessarily, in any one of the claims dependent thereon.

According to the present invention there is moreover provided a mountain boot as defined in claim 13 and preferably, though not necessarily, in any one of the claims dependent thereon.

BRIEF DESCRIPTION OF THE DRAWINGS

The present invention will now be described with reference to the accompanying drawings, which illustrate a non-limiting embodiment thereof, wherein:

FIG. 4 is an exploded, perspective view of the thermal-insulating inner-boot shown in FIG. 3, with parts removed for clarity's sake; whereas

DESCRIPTION OF THE EMBODIMENTS

With reference to FIGS. 1 to 5, number 1 denotes, as a whole, a thermal-insulating inner-boot, which is shaped so as to accommodate and protect the user's foot and lower leg, preferably substantially up to the base of the calf, and is designed to minimize heat loss to the outside.

In addition, the thermal-insulating inner-boot 1 is particularly adapted to be incorporated/used in a mountain boot 100 with high thermal insulation, preferably of a type suitable for mountaineering at altitudes above 4000-5000 metres.

In other words, the mountain boot 100 is preferably a mountaineering boot, optionally suitable for crampons.

Figure 1:
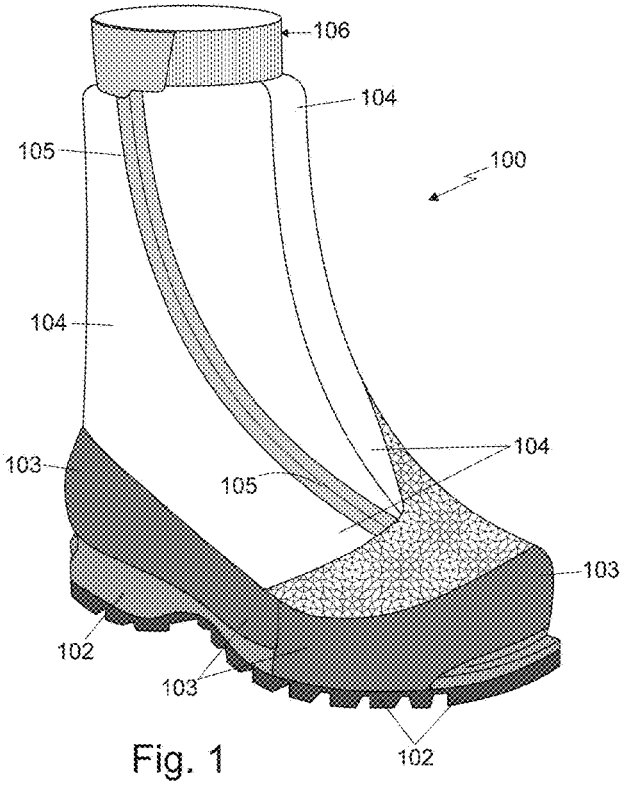
FIGS. 1 and 2 are two perspective views of a mountain boot provided with a thermal-insulating inner-boot made according to the teachings of the present invention, with parts removed for clarity's sake.
Figure 2:
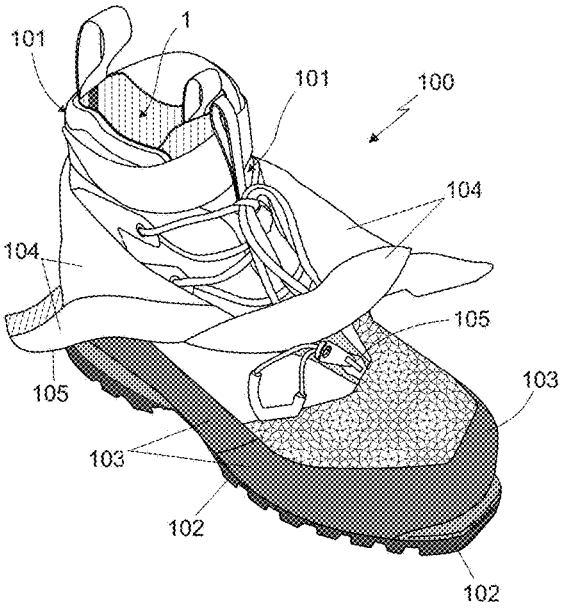

With reference to FIGS. 1 and 2, in particular, the mountain boot 100 preferably comprises: a main upper 101 preferably with a semi-rigid and/or thermal-insulating structure, which is shaped so as to accommodate and protect the user's foot and lower leg, preferably substantially up to the base of the calf, and is preferably locally stiffened by a substantially rigid front toe cap and/or rear counter (not visible in the figures); a sole 102 preferably with a substantially rigid structure, which is stably fixed underneath the upper 101 preferably by sewing and/or gluing, is structured/dimensioned so as to cover the entire sole of the user's foot, and is provided with a cleated-profile tread; and a lace or other manually-operated closing system, which is capable of tightening the upper 101 on the user's foot.

More specifically, the upper 101 is preferably mainly made of leather and/or synthetic fabric, optionally waterproof, and is preferably internally lined with a lining of soft and/or thermal-insulating material (not visible in the figures) . The front toe cap and/or rear counter, on the other hand, are preferably made of rigid plastic material.

The sole 102, in turn, preferably includes one or more superimposed layers of polymeric material foam, advantageously with closed cells, and is preferably stiffened by a plate-like core made of plastic material (not visible in the figures). Preferably, the tread of sole 102 is moreover made of vulcanized rubber or other elastomeric material with a high friction coefficient.

Finally, the sole 102 is preferably also provided with a front insert and a rear insert which are substantially rigid and preferably made of plastic material, emerge outside of sole 102 and are preferably shaped so as to allow the fitting of ice crampons.

With reference to FIGS. 1 and 2, preferably the mountain boot 100 moreover includes an additional protective band 103, preferably made of high-strength elastomeric material, which overlaps and covers the lower part of the upper 101, preferably while also joining to the underlying sole 102, so as to strengthen and protect the part of upper 101 intended to accommodate the user's foot from impacts and/or abrasions.

More specifically, protective band 103 is preferably substantially annular in shape so as to surround the lower part of upper 101 preferably seamlessly, and is stably fixed to the upper 101 preferably by sewing and/or gluing. Preferably, the protective band 103 furthermore joins the underlying sole 102 seamlessly along the entire perimeter of the sole.

With reference to FIGS. 1 and 2, preferably the mountain boot 100 additionally comprises: a soft and flexible protective gaiter 104, separate and distinct from the upper 101, which surrounds and protects at least part of the upper 101, is inferiorly firmly attached at the upper 101, and preferably extends cantilevered upwards beyond the top of upper 101, so as to surround and cover the upper 101 and part of the user's leg; and optionally also a zip 105 for the rapid opening of the gaiter 101.

More specifically, gaiter 104 is preferably shaped roughly like an overturned funnel, optionally so as to contain substantially the entire upper 101, and is inferiorly attached to the upper 101 preferably by sewing and/or gluing.

The zip 105, on the other hand, is placed on the gaiter 104 so that the user can quickly open the gaiter 104 to make it easier to insert the foot into the footwear.

In addition, gaiter 104 preferably has a waterproof structure and is preferably stably attached to the upper 101 underneath the additional protective band 103. Preferably, the gaiter 104 is moreover provided with an elasticated collar 106, which is capable of tightening directly on the user's leg spaced above the top of the upper 101, so as to keep the gaiter 104 in place on the user's leg.

The zip 105, in turn, is preferably of the watertight type, and preferably extends along the gaiter 104, roughly from the area above the upper front part of the upper 101 to the upper opening of the gaiter 104, or rather to the collar 106.

With reference to FIGS. 1 to 5, the thermal-insulating inner-boot 1 is completely separate and distinct from the upper 101 and the gaiter 104, and is adapted to be inserted in easily removable manner within the upper 101 and the gaiter 104, so as to increase the thermal insulation capability of the mountain boot 100.

The manually-operated closing system of the boot 100 is thus adapted to tighten the main upper 101 against the thermal-insulating inner-boot 1.

The thermal-insulating inner-boot 1, in addition, has a sock-like structure comprising: a soft and flexible upper 2 with a thermal-insulating structure, which is shaped roughly like an overturned funnel and is dimensioned so as to cover the user's foot and lower part of the leg preferably roughly up to the base of the calf; and a soft and flexible plate-like insole 3 with a thermal-insulating structure, which is arranged to close the lower opening of the upper 2 so as to cover the sole of the user's foot.

In other words, the plate-like insole 3 is substantially complementary in shape to the lower opening of the upper 2, and is firmly and stably attached to the upper 2, or rather to the lower edge/hem of the upper 2, preferably by sewing and/or gluing, so as to completely close the opening.

Preferably, the thermal-insulating inner-boot 1 moreover includes a soft and flexible protective sole 4, preferably with a waterproof structure, which is arranged to cover substantially the entire bottom or outer face of the insole 3 and optionally also at least part of the lower edge of the upper 2, and is stably attached to the insole 3, and optionally to the upper 2, preferably by sewing and/or gluing.

Figure 3:
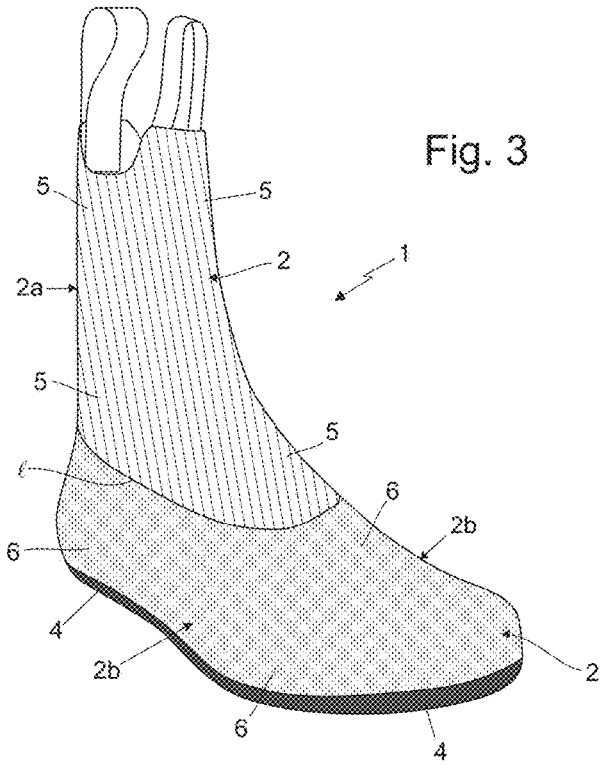
FIG. 3 is a perspective view of the thermal-insulating inner-boot partially visible in FIG. 2, with parts removed for clarity's sake.
Figure 4:
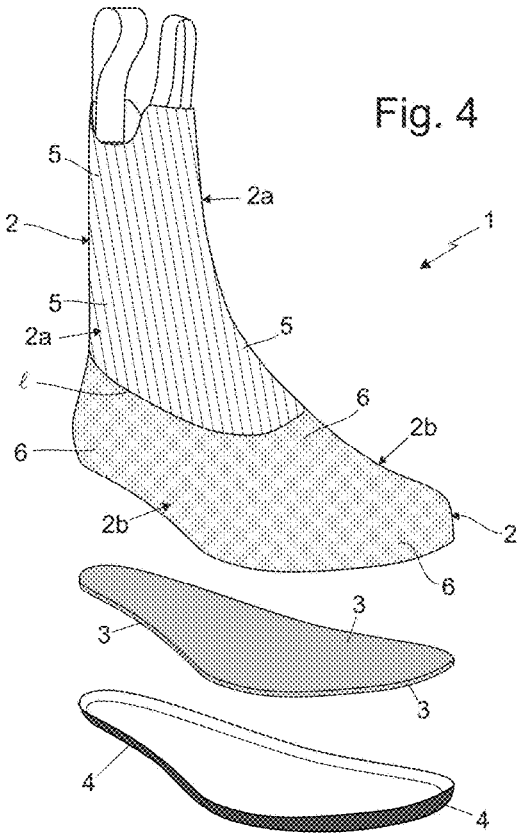
Figure 5:
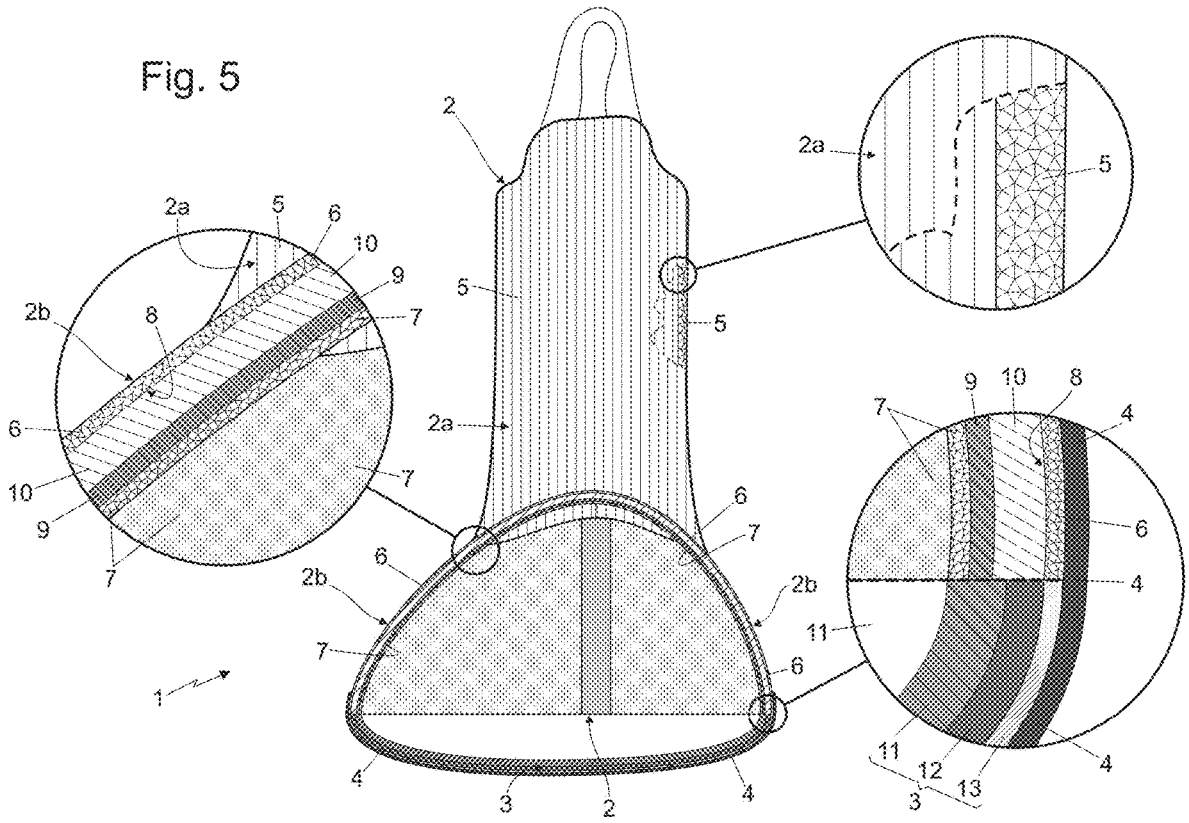
FIG. 5 is a front view of the thermal-insulating inner-boot shown in FIG. 3, with the front part sectioned along a transversal plane.

With reference to FIGS. 3, 4 and 5, in addition the thermal-insulating upper 2 includes a single-piece knitted fabric structure which has, inside itself, at least one cavity-wall, and furthermore includes also at least one sheet/piece of soft and flexible thermal-insulating material of appropriate thickness, which is stably trapped within said cavity-wall. The sheet(s)/piece(s) of thermal-insulating material form(s) at least part of the thermal-insulating padding of the upper 2.

In addition, said cavity-wall is preferably substantially annular in shape and is preferably arranged on the upper 2 so as to surround the user's foot, advantageously seamlessly and preferably while remaining substantially flush/contiguous with/to the insole 3.

More specifically, the thermal-insulating upper 2 has at least a first sector with a double-layer knitted fabric structure, which is preferably contiguous with the insole 3 and comprises: a first flap of knitted fabric that extends grazing a first side of the sheet/piece of thermal-insulating material; and a second flap of knitted fabric, which is made in one piece with the first flap of knitted fabric by the knitting machine and extends grazing the sheet/piece of thermal-insulating material on the side opposite the first flap of knitted fabric, so as to form a pocket containing said sheet/piece of thermal-insulating material.

In other words, the second flap of knitted fabric has a first margin stably joined to the first flap of knitted fabric substantially seamlessly, i.e. without sewing.

The cavity-wall of the knitted fabric structure is clearly formed within said pocket.

Preferably, the second flap of knitted fabric is moreover firmly attached to the first flap of knitted fabric, advantageously by sewing and/or gluing and/or heat sealing, also along a second hem opposite and/or complementary to the first margin, so as to close the pocket.

In addition, the second flap of knitted fabric preferably faces the inside of the upper 2 and is preferably made at least partially of thermal-insulating yarns. More specifically, the second flap of knitted fabric is preferably made entirely of thermal-insulating yarns.

Preferably, the thermal-insulating upper 2 moreover has at least one second sector contiguous to said first sector, which has a single-layer knitted structure that joins substantially seamlessly, i.e. without sewing, the double layer knitted structure of the first sector.

In other words, the first and second sectors of the thermal-insulating upper 2 are made in one piece by a knitting machine, without connecting sewings.

Preferably, the single-layer knitted structure is moreover made at least partially of elastic and/or thermal-insulating yarns.

More specifically, with reference to FIGS. 3, 4 and 5, the thermal-insulating upper 2 is preferably longitudinally divided into a top tubular segment 2*a* and a bottom tubular segment 2*b* that seamlessly join to one another.

The top tubular segment 2*a* is preferably shaped so as to accommodate/contain the lower part of the user's leg and, advantageously, also the upper part of the user's foot.

The bottom tubular segment 2*b*, on the other hand, is shaped so as to accommodate/contain at least the lower part of the user's foot and adjoins the insole 3. In other words, the insole 3 is arranged to close the opening of the bottom tubular segment 2*b*.

In the example shown, in particular, the boundary line $\ell$ between the tubular segments 2*a* and 2*b* is preferably placed on the upper 2 spaced below the tibiotarsal joint. Clearly, the boundary line $\ell$ is a closed line.

With reference to FIGS. 3, 4 and 5, in addition, the top tubular segment 2*a* preferably has a single-layer knitted structure.

More specifically, the top tubular segment 2*a* preferably comprises a flap of knitted fabric 5 of appropriate thickness, which substantially copies the shape of the top tubular segment 2*a*, i.e. is shaped so as to cover the lower part of the user's leg, and preferably has a single-layer elastic knitted structure so as to be able to adapt to the morphology of the user's leg.

Preferably, the flap of knitted fabric 5 is moreover made at least partially of elastic and/or thermal-insulating yarns.

In the example shown, in particular, the flap of knitted fabric 5 has a nominal thickness preferably ranging between 1 and 8 mm (millimetres), and preferably has a texture (i.e. the weaving pattern of the weft and warp yarns) with a substantially vertical ribbed knit, so as to have an elastic behaviour.

In addition, the flap of knitted fabric 5 is preferably also made at least partially of hollow-fibre thermal-insulating yarns, such as Primaloft polyester, or the like.

With reference to FIGS. 3, 4 and 5, the bottom tubular segment 2*b*, on the other hand, preferably has a double-layer knitted structure that seamlessly joins to the knitted structure of top tubular segment 2*a*, or rather to the flap of knitted fabric 5.

This double-layer knitted structure, in addition, is preferably shaped so as to form a large annular pocket, which surrounds the user's foot and is substantially entirely filled/occupied by one or more sheets of soft and flexible thermal-insulating material.

Preferably, the annular pocket of the double-layer knitted structure of the bottom tubular segment 2*b* is also adjacent/contiguous to the insole 3.

With reference to FIG. 5, in particular, the bottom tubular segment 2*b* preferably comprises: a first flap of knitted fabric 6 that seamlessly joins to the knitted structure of the top tubular segment 2*a*, or rather to the flap of knitted fabric 5, and substantially copies the shape of the bottom tubular segment 2*b*, i.e. it is shaped so as to cover at least the lower part of the user's foot; a second flap of knitted fabric 7, which extends underneath the flap of knitted fabric 6, substantially grazing the latter, and is superiorly joined to the flap of knitted fabric 6 substantially seamlessly, so as to form with the latter at least one padding pocket 8 with opening facing the lower free edge of the bottom tubular segment 2*b*; and one or more sheets of soft and flexible thermal-insulating material that occupy/fill the pocket 8 preferably substantially entirely.

Preferably, the sheet(s) of thermal-insulating material is/are also stably attached to one or both flaps of knitted fabric 6 and/or 7, advantageously by gluing.

More specifically, the flap of knitted fabric 7 preferably substantially copies the shape of the flap of knitted fabric 6, i.e. the shape of the bottom tubular segment 2*b*, and has the upper edge/margin that substantially seamlessly joins the flap of knitted fabric 6, so as to form, with the flap of knitted fabric 6, a large pocket 8 substantially annular in shape, which surrounds the user's foot substantially seamlessly.

In the example shown, in particular, the flap of knitted fabric 7 is preferably superiorly joined to the flap of knitted fabric 6 along the boundary line $\ell$ between the tubular segments 2*a* and 2*b*. In other words, the flap of knitted fabric 7 seamlessly joins the flap of knitted fabric 6 and the flap of knitted fabric 5, along the boundary line $\ell$.

In addition, the lower edge/hem of the flap of knitted fabric 7 is preferably firmly attached to the flap of knitted fabric 6, preferably by sewing and/or gluing.

Preferably, the nominal thickness of the flap of knitted fabric 6 and/or flap of knitted fabric 7 is also less than the nominal thickness of the flap of knitted fabric 5.

Furthermore, the flap of knitted fabric 7 is preferably made of yarns different from those of the flap of knitted fabric 6, and/or preferably has a texture (i.e. the weaving pattern of the weft and warp yarns) different from that of the flap of knitted fabric 6.

More specifically, the flap of knitted fabric 7 is preferably made entirely of thermal-insulating yarns, and preferably has a tighter weave than that of the flap of knitted fabric 6.

The flap of knitted fabric 6, on the other hand, is preferably made of yarns with high shear strength and/or abrasion resistance.

In the example shown, in particular, the flap of knitted fabric 7 is preferably made entirely of hollow-fibre thermal-insulating yarns, such as Primaloft polyester or the like, whereas the flap of knitted fabric 6 is preferably made entirely of polyamide yarns, and more conveniently of nylon yarns.

With reference to FIG. 5, in addition the bottom tubular segment 2*b* preferably has, within the pocket 8 formed by the flaps of knitted fabric 6 and 7, two sheets of thermal-insulating material 9 and 10 superimposed to one another.

Preferably, the sheets of thermal-insulating material 9 and 10 are moreover firmly attached to each other and/or to the flaps of knitted fabric 6 and 7 by gluing.

In addition, the inner sheet of thermal-insulating material 9, i.e. the sheet of thermal-insulating material grazing the flap of knitted fabric 7, is preferably made of polymeric material foam with open cells. Instead, the outer sheet of thermal-insulating material 10, i.e. the sheet of thermal-insulating material grazing the flap of knitted fabric 6, is preferably made of fleece or other non-woven fabric.

Preferably, the nominal thickness of the outer sheet of thermal-insulating material 10 is furthermore greater than that of the inner sheet of thermal-insulating material 9.

Clearly, the position of the sheets of thermal-insulating material 9 and 10 may also be reversed.

With reference to FIGS. 3, 4 and 5, the insole 3, in turn, is preferably firmly attached to both flaps of knitted fabric 6 and 7, and preferably has a multilayer structure that preferably includes at least one layer of polymeric material foam of sufficient thickness, stably coupled to a thin, flexible sheet of support material.

More specifically, in the example shown, the insole 3 is preferably firmly attached to the flaps of knitted fabric 6 and 7 of the bottom tubular segment 2*b* via Strobel sewing, and is preferably made up of two superimposed layers of polymeric material foam 11 and 12, advantageously with open cells, which preferably differ from each other in density and/or stiffness and/or hardness and/or polymeric composition, and are stably coupled to a sheet of synthetic support fabric 13.

Clearly, the sheet of synthetic fabric 13 may be replaced by a sheet of felt or the like.

With reference to FIG. 5, the protective sole 4 is preferably attached directly to the sheet of flexible material of the insole 3, or rather to the sheet of synthetic fabric 13, clearly on the side opposite the sheets of thermal-insulating material 9 and 10.

Moreover, the protective sole 4 preferably also consists of a solid, compact patch of polymeric material having a nominal thickness preferably ranging between 1 and 3 mm, is preferably substantially in the shape of an oblong basin, and is dimensioned so as to completely cover the bottom face of the insole 3 and preferably also at least part of the lower edge of the upper 2.

Operation of the thermal-insulating inner-boot 1 and of the mountain boot 100 is easily inferable from the above description, and therefore requires no further explanation.

The advantages connected to the particular structure of the thermal-insulating inner-boot 1 are noteworthy.

Firstly, the knitted-structure upper 2 makes it easier to assemble the thermal-insulating inner-boot 1, with the costs reduction that this entails. The assembly of the thermal-insulating inner-boot 1, in fact, requires a fewer number of sewings that a traditional thermal-insulating inner-boot.

Furthermore, with the same thermal insulation, the knitted-structure upper 2 is enormously more breathable than the corresponding part of a traditional thermal-insulating inner-boot, making it much quicker to dry the inside of the footwear after use.

Lastly, thanks to the knitted-structure upper 2, the thermal-insulating inner-boot 1 is much softer and more flexible than a traditional thermal-insulating inner-boot, and is therefore more comfortable to wear.

The thermal-insulating inner-boot 1, in fact, can adapt much better to the morphology of the user's foot and leg.

It is finally clear that modifications and variations may be made to the thermal-insulating inner-boot 1 and/or to the other components of the mountain boot 100 without however departing from the scope of the present invention.

For example, the flap of knitted fabric 7 of the bottom tubular segment 2*b* may extend over the flap of knitted fabric 6.

In addition, the texture (i.e. the weave pattern of the weft and warp yarns) of the flap of knitted fabric 6 and/or the flap of knitted fabric 7 may change according to the position on the upper 2.

Furthermore, in a less sophisticated embodiment, the cavity-wall formed by the knitted fabric structure of the upper 2, i.e. the pocket 8 bounded by the two flaps of knitted fabric 6 and 7, may also be substantially U- or C-shaped, so as to only embraces, for example, the toe or heel of the user's foot.

In other words, the cavity-wall formed by the knitted fabric structure of the upper 2, i.e. the pocket 8 bounded by the two flaps of knitted fabric 6 and 7, may be oblong in shape and may be located on the upper 2 so as to at least partially embrace the user's foot.

Finally, in a more sophisticated embodiment, also the top tubular segment 2*a* may be equipped with a double-layer knitted structure, which seamlessly joins the knitted structure of the bottom tubular segment 2*b*, and has at least one inner pocket preferably annular in shape, which is occupied/filled with one or more sheets/pieces of soft, flexible thermal-insulating material of sufficient thickness.

The invention claimed is:

1. A thermal-insulating inner-boot (1) for mountain boots (100), the inner boot comprising:

an upper (2) with a thermal-insulating structure, which is shaped so as to cover the user's foot and the lower part of the leg; and a plate-like insole (3) with a thermal-insulating structure, which is arranged to close a lower mouth of the upper (2) so as to cover the sole of the user's foot;

wherein said upper (2) is shaped in a form of an overturned funnel and is longitudinally divided into a top tubular segment (2*a*) and a bottom tubular segment (2*b*) that seamlessly join to one another: the top tubular segment (2*a*) is shaped so as to contain the lower part of the user's leg; the bottom tubular segment (2*b*) is shaped so as to contain at least the lower part of the user's foot;

the thermal-insulating inner-boot being characterised in that the upper (2) includes is a single-piece structure made of knitted fabric (5, 6, 7) that has a wall provided with at least one cavity-wall (8); and at least one sheet/piece of soft and flexible thermal-insulating material (9, 10) which is stably trapped within said cavity-wall (8) to form a thermal-insulating padding of the upper;

wherein the bottom tubular segment (2*b*) of the upper (2) includes at least one first sector of said single-piece structure made of knitted fabric (5, 6, 7), which first sector has a double layer knitted structure so as to form the cavity-wall (8) accommodating said at least one sheet/piece of soft and flexible thermal-insulating material (9, 10); and wherein the top tubular segment (2*a*) of said upper (2) includes at least one second sector of said single-piece structure made of knitted fabric (5, 6, 7), which is contiguous to said first sector, has a single-layer knitted structure and seamlessly joins to said first sector having the double layer knitted structure.

2. The thermal-insulating inner-boot according to claim 1, wherein said cavity-wall (8) is oblong in shape and is located on said upper (2) so as to at least partially embrace the user's foot.

3. The thermal-insulating inner-boot according to claim 2, wherein said cavity-wall (8) is substantially annular in shape and is located on said upper (2) so as to surround the user's foot.

4. The thermal-insulating inner-boot according to claim 2, wherein said cavity-wall (8) is contiguous with said insole (3).

5. The thermal-insulating inner-boot according to claim 1, wherein the first sector (2*b*) of said single-piece structure made of knitted fabric (5, 6, 7) comprises: a first flap of knitted fabric (6) that extends grazing a first side of said sheet/piece of thermal-insulating material (9, 10); and a second flap of knitted fabric (7) which is made in one piece with said first flap of knitted fabric (6), and extends grazing said sheet/piece of thermal-insulating material (9, 10), on the side opposite to said first flap of knitted fabric (6), so as to form at least one pocket (8) that contains said sheet/piece of thermal-insulating material (9, 10); the cavity-wall being formed within said pocket (8).

6. The thermal-insulating inner-boot according to claim 5, wherein said second flap of knitted fabric (7) is joined substantially seamlessly to said first flap of knitted fabric (6) along a first margin, and is firmly attached to said first flap of knitted fabric (6) along a second hem complementary and/or opposite to said first margin.

7. The thermal-insulating inner-boot according to claim 5, wherein said second flap of knitted fabric (7) faces the inside of the upper (2) and is made partially or entirely of thermal-insulating yarns.

8. The thermal-insulating inner-boot according to claim 5, wherein said insole (3) is firmly fixed to both said first flap of knitted fabric (6) and said second flap of knitted fabric (7).

9. The thermal-insulating inner-boot according to claim 1, wherein the second sector of said single-piece structure made of knitted fabric (5, 6, 7) comprises a third flap of knitted fabric (5) that substantially copies the shape of said top tubular segment (2*a*), and has a single-layer elastic knitted structure.

10. The thermal-insulating inner-boot according to claim 9, wherein said third flap of knitted fabric (5) is made at least partially of elastic and/or thermal-insulating yarns.

11. The thermal-insulating inner-boot according to claim 1, wherein said insole (3) has a multilayer structure that comprises one or more layers of polymeric material foam (11, 12) stably coupled to a flexible sheet of support material (13).

12. The thermal-insulating inner-boot according to claim 1, characterised by further comprising a soft and flexible protective sole (4) that is arranged to cover substantially the entire bottom face of the plate-like insole (3).

13. A mountain boot (100) comprising:

a main upper (101) shaped so as to accommodate and protect the user's foot and leg; a sole (102) which is stably fixed underneath the upper (101) and has a cleated-profile tread;

a thermal-insulating inner-boot (1), separate and distinct from the main upper (101), which is inserted in easily removable manner within said main upper (101), and is shaped so as to accommodate and protect the user's foot and lower part of the leg; and a manually-operated closing system adapted to tighten the main upper (101) on said inner-boot;

the mountain boot (100) being characterised in that said thermal-insulating inner-boot (1) is realized according to claim 1.

14. The mountain boot according to claim 13, characterised by further comprising a soft and flexible gaiter (104), separate and distinct from said main upper (101), that surrounds the main upper (101), is inferiorly stably attached to the main upper (101), and extends cantilevered upwards, beyond the top of the main upper (101), so as to cover and protect said main upper (101) and a part of the user's leg.

15. The mountain boot according to claim 14, characterised by further comprising an additional protective band (103) that overlaps and covers the lower part of the main upper (101), while also joining the underlying sole (102); the gaiter (104) being stably fixed to the main upper (101) underneath said additional protective band (103).

* * * * *